United States Patent [19]

Breeze

[11] Patent Number: 4,458,433

[45] Date of Patent: Jul. 10, 1984

[54] DESK CALENDAR

[75] Inventor: Alan G. Breeze, Agincourt, Canada

[73] Assignee: Intergraphics Design Inc., Toronto, Canada

[21] Appl. No.: 381,028

[22] Filed: May 24, 1982

[30] Foreign Application Priority Data

May 27, 1981 [CA] Canada ..... 378429

[51] Int. Cl.[3] ..... G09D 3/00

[52] U.S. Cl. ..... 40/107; 40/488; 446/13

[58] Field of Search ..... 40/107, 109, 488, 10 D, 40/335, 358, 539, 152; 46/2, 1 L

[56] References Cited

U.S. PATENT DOCUMENTS

| | | | |
|---|---|---|---|
| 237,584 | 2/1881 | Ogle | 40/107 |
| 1,246,385 | 11/1917 | Bimeler | 40/358 |
| 2,020,176 | 11/1935 | Fleischer | 46/2 |
| 3,049,814 | 8/1962 | McLain | 40/10 D |
| 3,561,146 | 2/1971 | Dembar | 40/152 |

FOREIGN PATENT DOCUMENTS

| | | | |
|---|---|---|---|
| 460601 | 4/1926 | Fed. Rep. of Germany | 10 D/ |

*Primary Examiner*—Robert P. Swiatek
*Assistant Examiner*—David I. Tarnoff
*Attorney, Agent, or Firm*—Ridout & Maybee

[57] ABSTRACT

A desk calendar is disclosed comprising a hollow body of rectangular hexagonal form in transverse cross-section having six side faces. Calendar indicia denoting the days of the months of a twelve months period is presented on an inner hexagonal sleeve thereby to be visible on the six side faces of the body where the body is of transparent material, or is presented on the six side faces of the body in which case the inner sleeve is omitted, the calendar indicia denoting two months of the twelve months period being in side-by-side relationship on each side face. A hexagonal masking sleeve which may present advertising or other promotional matter is mounted on the body for slidable movement between a first position in which the masking sleeve covers the calendar indicia denoting one of the two months on each side face and a second position in which the masking sleeve covers the calendar indicia denoting the other of the two months on each side face.

10 Claims, 4 Drawing Figures

DESK CALENDAR

This invention relates to desk calendars, and has as a primary object the provision of an improved form of desk calendars which are pleasing and attractive in appearance. It is also an object of the present invention to provide such a desk calendar in which, for example, advertising matter may be presented on one or more of the structural parts of the calendar so that the calendar is particularly adapted to be distributed on a cost-free basis by commercial and industrial concerns to their customers and potential customers for promotional purposes.

According to one aspect of the present invention there is provided a desk calendar comprising a body of hexagonal prismatic form having six side faces, calendar indicia denoting the days of the months of a twelve months period being visible on said six side faces, with the calendar indicia denoting two months of said twelve months period being in side-by-side relationship on each said side face. The calendar further comprises an outer masking sleeve of hexagonal form mounted exteriorly on the body for slidable movement thereon between a first position in which the masking sleeve covers the calendar indicia denoting one of the two months on each said side face and a second position in which the masking sleeve covers the calendar indicia denoting the other of the two months on each said side face.

According to a further aspect of the present invention there is provided a kit of parts comprising first and second blanks adapted to be erected into a body and masking sleeve for forming a desk calendar according to the present invention.

In order that the invention may be more clearly understood and more readily carried into effect the same will now, by way of example, be more fully described with reference to the accompanying drawings in which FIG. 1 is a view of a desk calendar according to a preferred embodiment of the invention;

Figure 1:
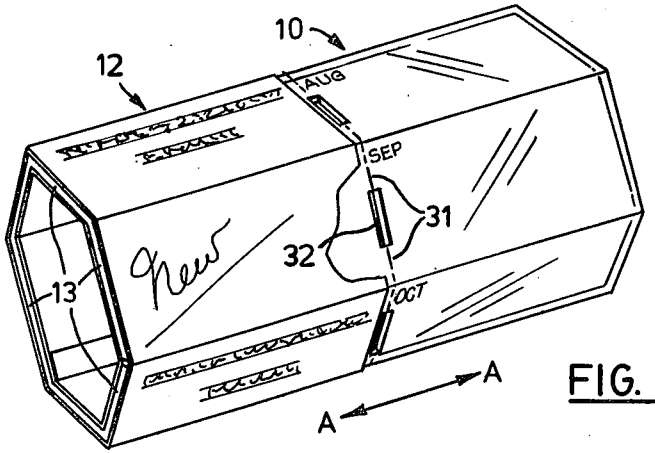

Referring to the drawings, 10 denotes generally a body which is of regular hexagonal prismatic form and which has six side faces 11. Operatively mounted on the body 10 is an outer masking sleeve 12 which is of corresponding hexagonal form to the body 10 and which is slidably movable along the body 10 as indicated by the arrows A—A in FIG. 1.

Figure 2:
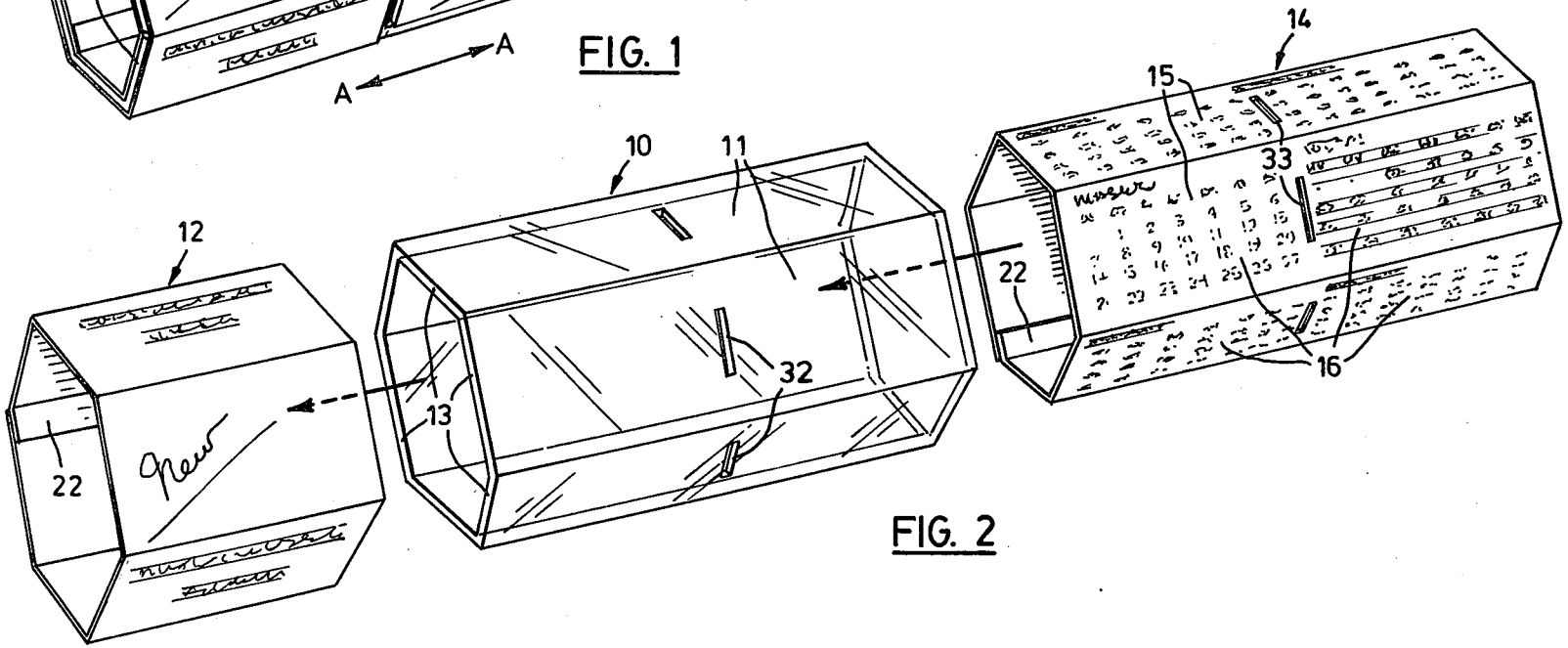
FIG. 2 is an exploded view, on an enlarged scale, of the desk calendar shown in FIG. 1.

With particular reference to the embodiment shown in FIGS. 1 and 2, the body 10 is of hollow form and has six side walls 13, the outer faces of which constitute the side faces 11. Furthermore, in this embodiment the body 10 is of transparent material, such as, for example, a transparent acrylic plastics material, and the calendar further comprises an inner sleeve 14 having outer side faces 15, the sleeve 14 being of hexagonal form corresponding to that of the body 10 and being operatively removably disposed within the body 10. Calendar indicia denoted generally by the reference numeral 16 are presented on the six side faces 15 of the sleeve 14 so that these calendar indicia 16 are visible through the walls 13 of the body 10 on the side faces 11 thereof. The calendar indicia 16 denote the days of the months of a twelve months period, which will usually be the twelve months period from January 1 to December 31, inclusive, of a particular calendar year, the calendar indicia 16 denoting two months of the twelve months period being in side-by-side relationship on each side face 15 of the sleeve 14, Referring now to the alternative embodiment shown in FIGS. 3 and 4, the same reference numerals are used as in FIGS. 1 and 2 to denote corresponding parts. This alternative embodiment of FIGS. 3 and 4 differs from the preferred embodiment hereinbefore described with reference to FIGS. 1 and 2 in that the inner sleeve 14 is omitted, and instead the calendar indicia 16 are presented on the side faces 11 of the body 10, the body 10 in this alternative embodiment being erected from a blank 17 of, for example, cardboard or the like. With particular reference to FIG. 4, the blank 17 comprises six panels 18 which are interconnected by fold lines 19 and which, when the blank 17 is in its erected condition, constitute, of course, the side walls 13 of the body 10, one of the end panels 18 presenting a glue flap 20 connected to this end panel 18 by a fold line 21. The masking sleeve 12, and with reference to the embodiment of FIGS. 1 and 2 also the inner sleeve 14, may likewise be formed from folded blanks of, for example, cardboard or the like having glue flaps 22.

Figure 3:
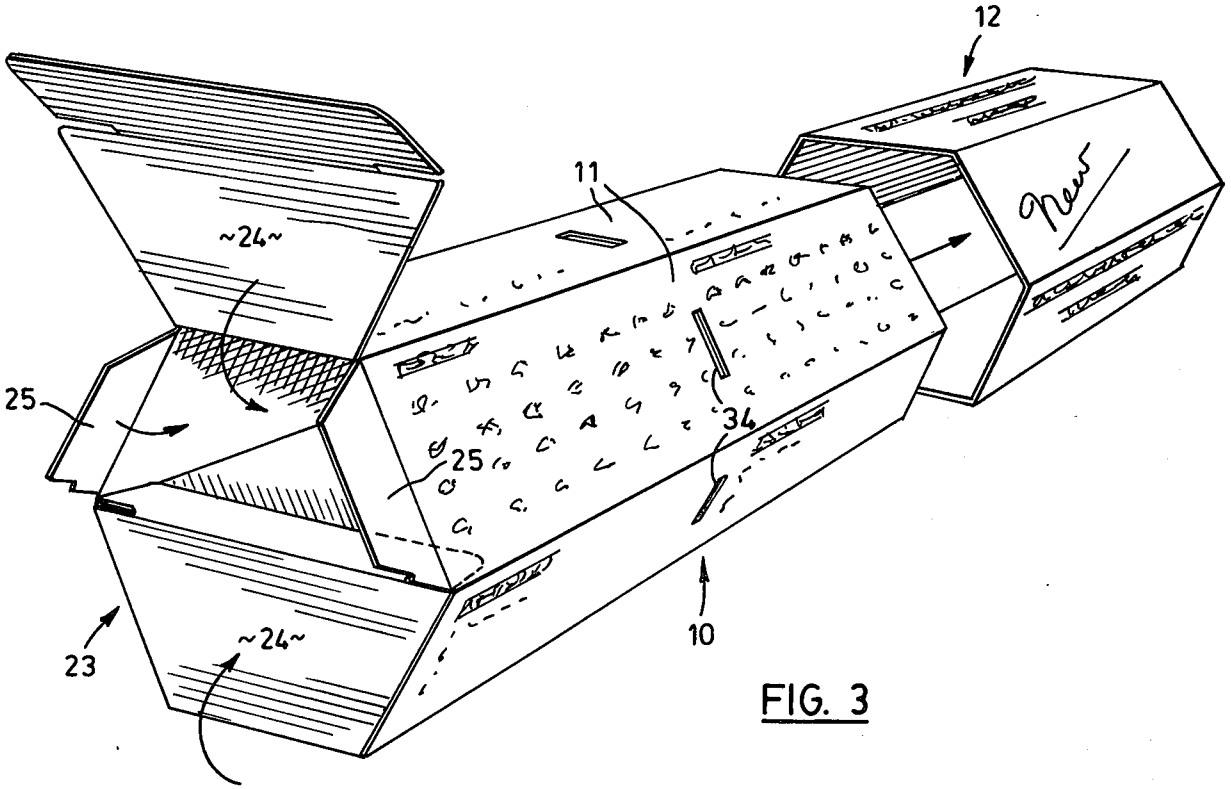
FIG. 3 is a view of a desk calendar according to an alternative preferred embodiment of the invention, the view showing the calendar in an exploded and partially erected condition.
Figure 4:
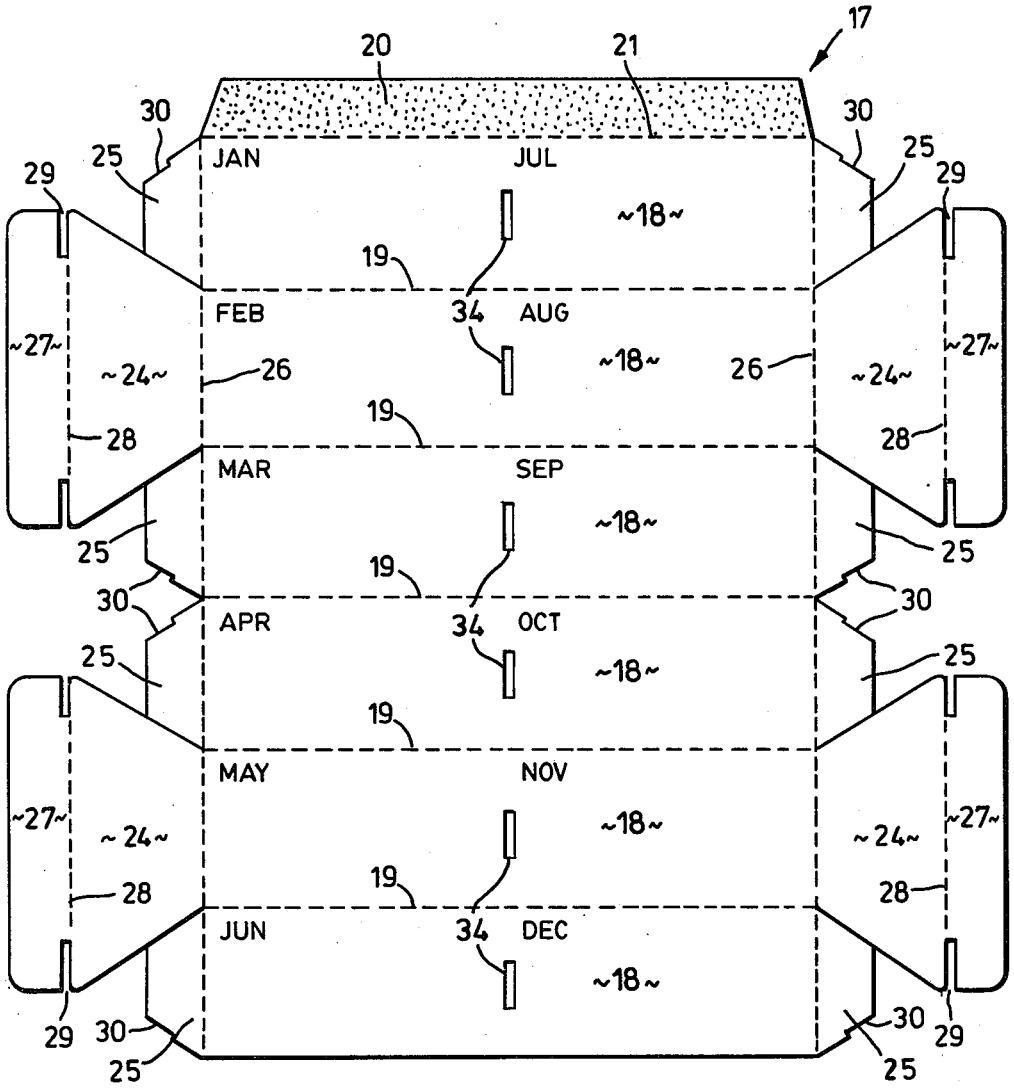
FIG. 4 is a plan view of a blank from which one of the parts of the calendar shown in FIG. 3 is formed.

Whereas in the embodiment of FIGS. 1 and 2 the body 10 is open-ended, it will be noted that in the alternative preferred embodiment of FIGS. 3 and 4 the body 10 has end walls 23. Each of these end walls 23 comprises two end panels 24 which are disposed at one end of each of two of the panels 18, said one end of each of the remaining panels 18 presenting a support flap 25, with the panels 24 being separated by two of the support flaps 25. The panels 24 and support flaps 25 are connected to the respective panels 18 by fold lines 26, securement flaps 27 being presented by the panels 24 remote from the respective panels 18 with the securement flaps 27 being connected by fold lines 28 to the panels 24.

As will be appreciated, the blank 17 is erected into the body 10 shown in FIG. 3 by first folding the panels 18 about the fold lines 19 and folding the glue flap 20 about the associated fold line 21 with this glue flap 20 being secured to the other end panel 18, and preferably to the inner face thereof so as not to mar the appearance of the outer face thereof. Thereafter, each end wall 23 is formed by inwardly folding about the appropriate fold lines 26 two of the support flaps 25 adjacent to one of the panels 24, and said one of the panels 24 is then inwardly folded about the associated fold line 26 to overlie said support flaps 25. The securement flap 27 associated with said one of the panels 24 is then inwardly folded about the associated fold line 28 and is interfittingly engaged with said support flaps 25. This interfitting engagement between the securement flap 27 and the associated support flaps 25 may be provided by slots 29 in the securement flap 27 adjacent to the fold line 28 and notches 30 in the appropriate side edges of the support flaps 25, the width of the slots 29 and of the notches 30 being substantially equal to the thickness of the cardboard or other material of which the blank 17 is formed, and the combined length of each slot 29 and the associated notch 30 being substantially equal to the length of the end edge of the support flap 25 in which the notch 30 is formed so that the associated slots 29 and notches 30 interfittingly engage as clearly shown in FIG. 3.

The two remaining support flaps 25 and the remaining opposed panel 24 together with the associated securement flap 27 are then likewise disposed in order to complete the end wall 23 at one end of the body 10, and thereafter the end wall 23 at the other end of the body 10 is similarly formed.

Referring again to both embodiments as hereinbefore described with reference to the accompanying drawings, the desk calendar is used by sitting one of the side faces 11 of the body 10, and of course the corresponding face of the masking sleeve 12, on the user's desk or other substantially horizontal support surface, the masking sleeve 12 being solidably disposed on the body 10 in a position in which the sleeve 12 covers the calendar indicia 16 denoting one of the two months on each side face 11, with the calendar indicia 16 denoting the days of the current month not being so covered by the sleeve 12 and being presented on the side face 11 which is upwardly directed and facing the user. Thus, with reference to FIG. 1 the calendar is in the condition in which it would be disposed when the current month is September.

As will be appreciated, the masking sleeve 12 is, when required, slidably moved on the body 10 to a further position in which the sleeve 12 instead covers the calender indicia 16 denoting the other of the two months on each side face 11 of the body 10. Alternatively, the calendar indicia 16 could be calendar indicia for a Chinese calendar in which case the calendar could be used by standing the calendar on end, i.e. with reference to the embodiment of FIGS. 3 and 4, by disposing one of the end walls 23 on the user's desk or other substantially horizontal support surface.

As shown in the accompanying drawings the calendar indicia 16 denoting the days of the first six months of the twelve months period in question are so disposed as to be covered by the masking sleeve 12 when in one of its above-described positions, with the calendar indicia 16 denoting the days of the second six months of the twelve months period in question being so disposed as to be covered by the sleeve 12 when in the second of its above-described positions, so that the sleeve 12 need be slidably moved on the body 10 between these positions only once during the twelve months period. It is, however, to be understood that in alternative embodiments the calendar indicia 16 denoting the days of the months of the twelve months period in question may be arranged in any other desired manner.

Still referring to both embodiments of the invention, the outer faces of the masking sleeve 12 may present advertising or other promotional matter, although alternatively these outer faces could be plain or could present merely decorative matter.

While in the embodiment shown in FIGS. 1 and 2 the body 10 is open-ended it will be appreciated that in this embodiment there could be provided end walls with the body 10 being in a plurality of separable parts to permit insertion and removal of the inner sleeve 14. Thus, for example, as shown in FIG. 1 the body 10 could be in two separable parts which are interconnectible by friction or other locking means about a join line 31 shown in FIG. 1 in chain-dotted form.

Where the embodiment shown in FIGS. 1 and 2 is so provided with end walls one or more, and preferably all, of the side walls 13 of the body 10 may each be provided with a coin slot 32, with a corresponding slot or slots 33 being provided in one or more of the side faces 15 of the sleeve 14, so that with the sleeve 14 operatively disposed within the body 10 the or each slot 33 is in alignment with the respective slot 32. Thus, the desk calendar may also serve as a coin collecting container with the coins being operatively inserted through the slot or slots 32 and the respective slot or slots 33 into the body 10. It will be appreciated that the slots 32, 33 are so positioned that these slots 32, 33 are not covered by the masking sleeve 12 when this masking sleeve 12 is in its operative positions as hereinbefore described, the slots 32, 33 preferably being centrally disposed in the respective side wall or walls 13 and in the respective side face or faces 15, respectively, with the or each slot 33 being between the calendar indicia 16 denoting one of the two months on the appropriate side face 15 and the calendar indicia 16 denoting the other of the two months on this side face 15. In the embodiment shown in FIGS. 3 and 4 a slot or slots 34 may likewise be provided in one or more of the side faces 11 of the body 10 for the same purpose.

In the embodiment of FIGS. 1 and 2 the desk calendar may be re-used for a number of different twelve months periods merely by replacing the inner sleeve 14. This is not, of course, the case with the alternative embodiment of FIGS. 3 and 4, but this alternative embodiment of FIGS. 3 and 4 can be conveniently stored and shipped, for example, by mail with the body 10 in the form of the unerected blank 17, or in the form of the unerected blank 17 with, however, the glue flap 20 secured to the said other end panel 18 and with of course the blank 17 folded about the appropriate fold line 18, namely, with reference to FIG. 4 the fold line 19 between the panels 18 presenting the months March and September and the months April and October, this form of the blank 17 being hereinafter also referred to as a blank. Furthermore, it will be appreciated that the masking sleeve 12, and with reference to the embodiment of FIGS. 1 and 2 also the inner sleeve 14, may for storage and shipment be disposed in an unerected condition with or without the glue flaps 22 secured in position.

While in the embodiment hereinbefore described with reference to FIGS. 3 and 4 the body 10 is hollow it will of course be appreciated that this body 10 could alternatively be solid and formed of wood or any other suitable material. In this case, of course, the desk calendar could not serve as a coin collecting container and would not therefore be provided with any slot or slots 34.

I claim:

1. A kit of parts comprising a first blank adapted to be erected into an elongate hollow body of hexagonal prismatic form having six side walls, end walls and a uniform hexagonal transverse cross-sectional configuration over substantially the entire length of the body, calendar indicia denoting the days of the months of a twelve months period being presented on outer faces of said six side faces, with the calendar indicia denoting two months of said twelve months period being in side-by-side relationship on each said side wall, and a second blank adapted to be erected into an outer masking sleeve of hexagonal form corresponding to the hexagonal form of the body and mounted exteriorly on the body for horizontal slidable movement of the sleeve along the length of the body, while maintaining the body in a substantially stationary position, between a first position in which the masking sleeve covers the calendar indicia denoting one of the two months on each said side wall and a second position in which the masking sleeve covers the calendar indicia denoting the other of the two months on each said side wall.

2. A desk calendar comprising an elongate transparent body of hexagonal prismatic form having six side faces and a uniform hexagonal transverse cross-sectional configuration over substantially the entire length of the body, calendar indicia denoting the days of the months of a twelve months period being presented on a hexagonal inner sleeve which is removably disposed within the body and visible through said six side faces, with the calendar indicia denoting two months of said twelve months period being in side-by-side relationship on each said side face, and an outer masking sleeve of hexagonal form corresponding to the hexagonal form of the body and mounted exteriorly on the body for permitting horizontal slidable movement of the sleeve along the length of the body, while maintaining the body in a substantially stationary position, between a first position in which the masking sleeve covers the calendar indicia denoting one of the two months on each said side face and a second position in which the masking sleeve covers the calendar indicia denoting the other of the two months on each said side face.

3. A desk calendar according to claim 1, wherein the calendar indicia covered by the masking sleeve when the masking sleeve is in said first position thereof is calendar indicia denoting the days of the first six months of said twelve months period, and the calendar indicia covered by the masking sleeve when the masking sleeve is in said second position thereof is calendar indicia denoting the days of the second six months of said twelve months period.

4. A desk calendar according to either one of claims 2 and 3, wherein advertising material is presented on outer faces of the masking sleeve.

5. A desk calendar according to claim 2, wherein the body is hollow and has six side walls outer faces of which constitute said six side faces.

6. A desk calendar according to claim 5, wherein the body is open-ended.

7. A desk calendar according to claim 5, wherein the body has end walls.

8. A desk calendar according to claim 5, wherein the body has end walls, and the body is in a plurality of separable parts.

9. A desk calendar comprising a hollow body of hexagonal prismatic form having six side walls, the outer faces of which constitute six side faces, end walls, calendar indicia denoting the days of the months of a twelve months period being visible on said six side faces, with the calendar indicia denoting two months of said twelve months period being in side-by-side relationship on each said side face, an outer masking sleeve of hexagonal form mounted exteriorly on the body for slidable movement thereon between a first position in which the masking sleeve covers the calendar indicia denoting one of the two months on each said side face and a second position in which the masking sleeve covers the calendar indicia denoting the other of the two months on each said side face, and wherein at least one of the side walls of the body has a coin slot therein, the coin slot being so positioned as to be uncovered when the masking sleeve is in said first position and in said second position thereof.

10. A desk calendar according to claim 9, wherein the coin slot is between the calendar indicia denoting one of the two months of said twelve months period on the side faces constituting the outer face of the side wall in which the coin slot is provided and the calendar indicia denoting the other of the two months of said twelve months period on said side face.

* * * * *